US009280088B2

(12) United States Patent
Fujii

(10) Patent No.: US 9,280,088 B2
(45) Date of Patent: Mar. 8, 2016

(54) DEVELOPER CONTAINER, IMAGE FORMING UNIT AND IMAGE FORMING APPARATUS

(71) Applicant: Oki Data Corporation, Tokyo (JP)

(72) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/614,046

(22) Filed: Feb. 4, 2015

(65) Prior Publication Data

US 2015/0227082 A1 Aug. 13, 2015

(30) Foreign Application Priority Data

Feb. 7, 2014 (JP) ..... 2014-022488

(51) Int. Cl.
*G03G 15/08* (2006.01)

(52) U.S. Cl.
CPC ..... *G03G 15/0865* (2013.01); *G03G 15/0887* (2013.01); *G03G 2215/0802* (2013.01)

(58) Field of Classification Search
CPC ..... G03G 15/0865; G03G 15/087; G03G 15/0887; G03G 2215/0802; G03G 2215/0819; G03G 2215/085
USPC ..... 399/263, 261
See application file for complete search history.

(56) References Cited

U.S. PATENT DOCUMENTS 6,229,976 B1 * 5/2001 Kimura ..... G03G 15/0872 222/DIG. 1
7,848,685 B2 * 12/2010 Nagashima ..... G03G 15/0865 399/258
8,229,332 B2 * 7/2012 Mase ..... G03G 15/0872 399/256
2009/0067888 A1 * 3/2009 Murata ..... G03G 15/0877 399/263
2010/0196059 A1 * 8/2010 Maeshima ..... G03G 15/0868 399/263
2011/0008076 A1 * 1/2011 Kuroyama ..... G03G 15/0868 399/263
2012/0243913 A1 * 9/2012 Murata ..... G03G 15/0875 399/263
2014/0003844 A1 * 1/2014 Oda ..... G03G 15/0839 399/263

FOREIGN PATENT DOCUMENTS

JP 2009-175772 A 8/2009

* cited by examiner

*Primary Examiner* — Christopher Mahoney

(74) *Attorney, Agent, or Firm* — Muncy, Geissler, Olds & Lowe, P.C.

(57) ABSTRACT

A developer container includes a developer containing part that has an cylindrical hollow shape inside and contains developer therein; and an agitation member that is elastic and rotatably provided inside the developer containing part, rotating around a rotation axis that is a center of the cylindrical hollow shape, having at least a side edge extending in the rotation axis. The developer containing part has a side wall part on one end thereof in a direction of the rotation axis of the agitation member, the side wall extending to correspond to the side edge of the agitation member and scraping a surface of the side wall while the agitation member rotates, the side wall part has a projection part that projects toward inside of the developer containing part so that the side edge of the agitation member is elastically deformed by the projection part when passing over the projection part.

19 Claims, 10 Drawing Sheets

DEVELOPER CONTAINER, IMAGE FORMING UNIT AND IMAGE FORMING APPARATUS

CROSS REFERENCE

The present application is related to, claims priority from and incorporates by reference Japanese Patent Application No. 2014-022488, filed on Feb. 7, 2014.

TECHNICAL FIELD

This invention relates to a developer container that contains developer, and relates to an image forming unit and an image forming apparatus that are provided with the developer container.

BACKGROUND

An image forming apparatus such as a printer, a facsimile and a multifunction machine is provided with a developer container to an image forming unit for supplying developer (for example, see Japanese Patent Laid-Open Publication No. 2009-175772 (FIGS. 2 and 11)).

However, there is a problem that, as a capacity of the developer container increases, developer remaining inside the developer container increases and the developer cannot be efficiently supplied to the image forming unit.

The present invention is made to solve the above-described problem. A purpose of the present invention is to make it possible to efficiently supply developer from a developer container.

SUMMARY

A developer container disclosed in the application includes a developer containing part that has an cylindrical hollow shape inside and contains developer therein; and an agitation member that is elastic and rotatably provided inside the developer containing part, rotating around a rotation axis that is a center of the cylindrical hollow shape, having at least a side edge extending in the rotation axis. The developer containing part has a side wall part on one end thereof in a direction of the rotation axis of the agitation member, the side wall extending to correspond to the side edge of the agitation member and scraping a surface of the side wall while the agitation member rotates, the side wall part has a projection part that projects toward inside of the developer containing part so that the side edge of the agitation member is elastically deformed by the projection part when passing over the projection part.

Further, an image forming unit, an image forming apparatus including the above image forming unit as well are disclosed.

According to the present invention, due to the contact between the agitation part and the projection parts, vibration is imparted to the side wall part of the developer container so that the developer attached to the side wall part can be shaken off. Therefore, the developer remaining inside the developer containing part can be reduced and the developer can be efficiently supplied.

DETAILED EMBODIMENTS

First Embodiment

<Configuration of Image Forming Apparatus>

Figure 1:
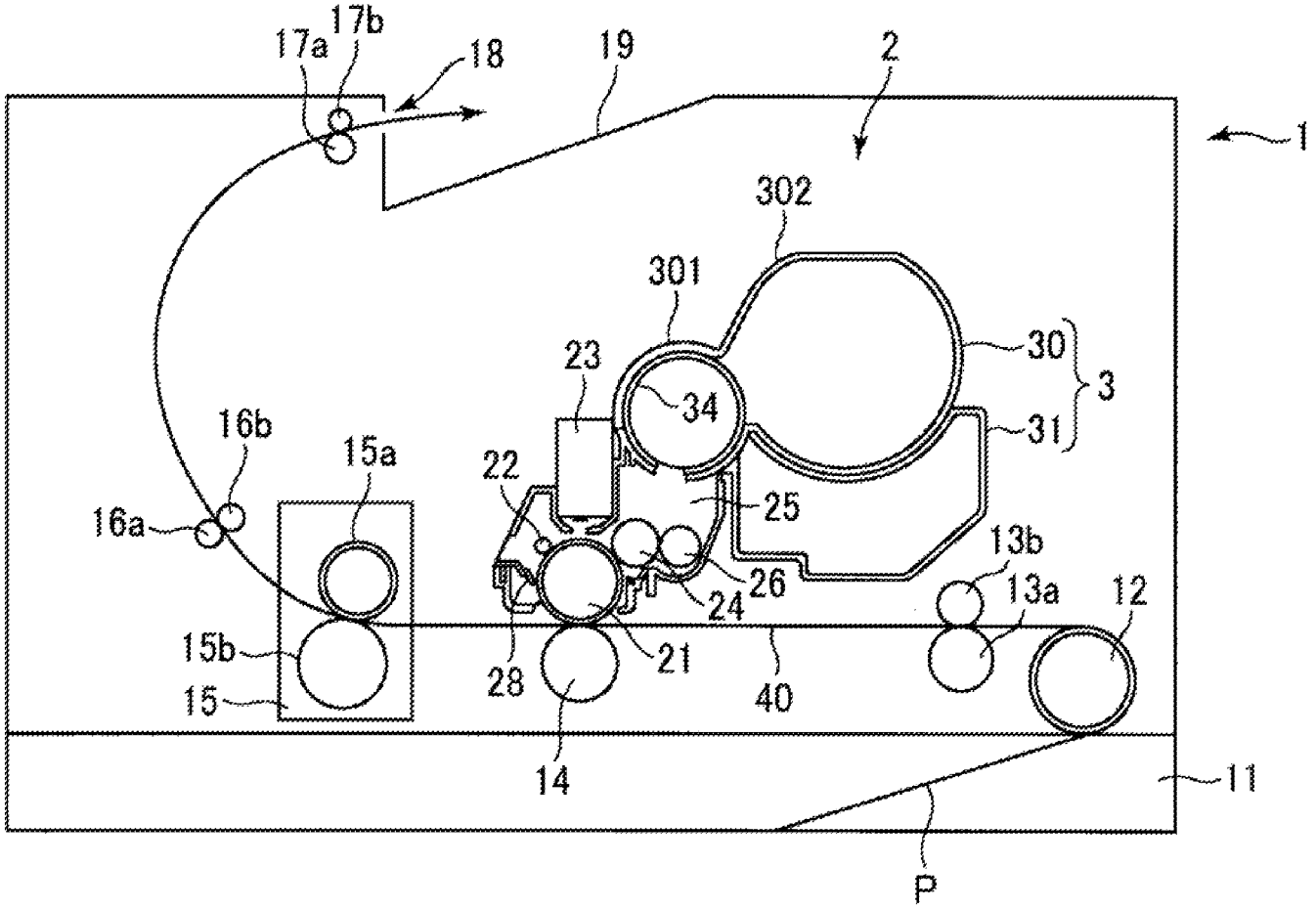
FIG. 1 illustrates a basic configuration of an image forming apparatus according to a first embodiment of the present invention.

FIG. 1 illustrates a basic configuration of an image forming apparatus according to a first embodiment of the present invention. Here, an image forming apparatus 1 is configured as an electrophotographic printer that uses an electrophotographic method to form an image. However, the image forming apparatus 1 is not limited to a printer, but may also be a copying machine, a facsimile machine, a multifunction machine, or the like.

The image forming apparatus 1 may be an image forming apparatus in which a plurality of image forming units are arranged to form a color image. However, here, for convenience of description, the image forming apparatus 1 is an image forming apparatus in which a single image forming unit 2 is used to form a monochromatic (for example, black) image.

As illustrated in FIG. 1, the image forming apparatus 1 includes a medium cassette 11 as a medium containing part that contains a recording medium P (such as a print sheet), a sheet feeding roller 12 as a medium supply part that feeds one by one the recording medium P contained in the medium cassette 11, and a pair of carrying rollers 13*a*, 13*b* as a medium carrying part that further carries the recording medium P that is fed by the sheet feeding roller 12.

The image forming apparatus 1 includes the image forming unit 2 (which is also referred to as a process unit) that forms a developer image (toner image) based image information, and a transfer roller 14 as a transfer member that transfers the developer image formed by the image forming unit 2 to a surface of the recording medium P. Configurations of the image forming unit 2 and the transfer roller 14 will be described later.

The image forming apparatus 1 further includes a fuser unit 15 as a fuser that fuses the developer image, which has been transferred to the recording medium P by the image forming unit 2, onto the recording medium P. The fuser unit 15, for example, has a fuser roller 15*a* and a pressure application roller 15*b*, and fuses the developer image onto the recording medium P by heat and pressure.

The image forming apparatus 1 further includes a pair of ejection rollers 16*a*, 16*b* that carries the recording medium P on which the developer image has been fused by the fuser unit 15 toward an ejection port 18, a pair of ejection rollers 17*a*, 17*b* that ejects the recording medium from the ejection port 18, and a stacker part 19 on which the recording medium ejected from the ejection port 18 is placed.

A medium carrying route 40 that is a carrying route of the recording medium is defined along the medium cassette 11, the sheet feeding roller 12, the pair of the carrying rollers 13*a*, 13*b*, the pair of the ejection rollers 16*a*, 16*b* and the pair of the ejection rollers 17*a*, 17*b*.

<Configuration of Image Forming Unit>

Figure 2:
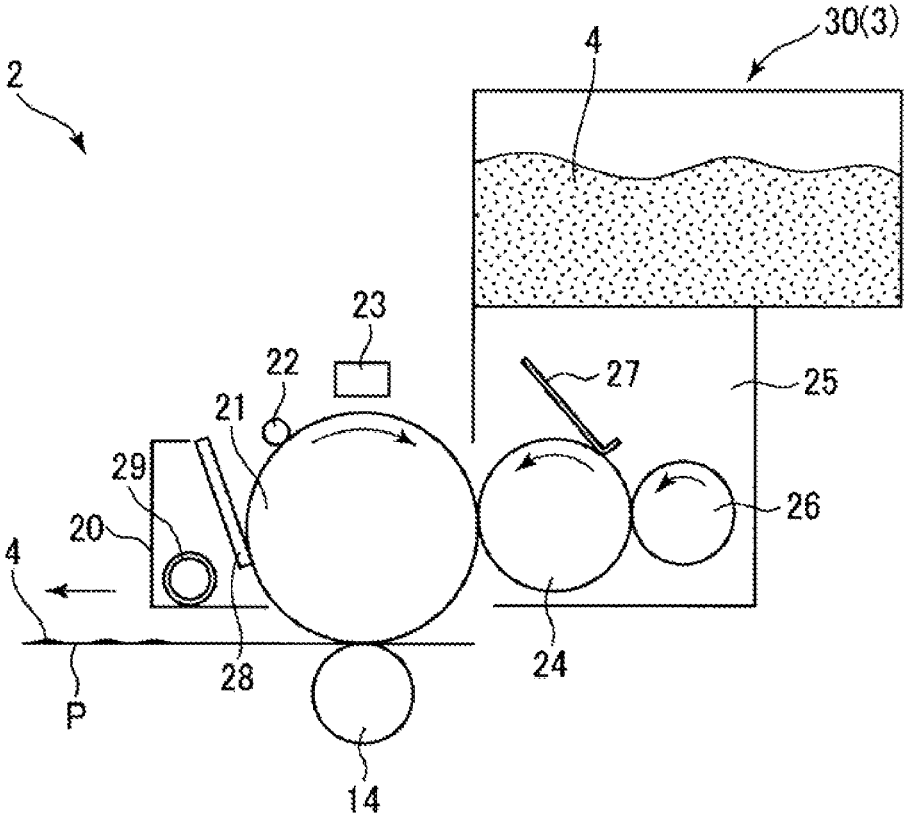
FIG. 2 illustrates a basic configuration of an image forming unit according to the first embodiment together with an LED head and a transfer roller.

FIG. 2 illustrates a basic configuration of the image forming unit 2 together with an LED head 23 and the transfer roller 14. As illustrated in FIG. 2, the image forming unit 2 has an image forming part 20 (image forming unit body) and a developer container 3 that is removably attached to an upper part of the image forming part 20.

Figure 9:
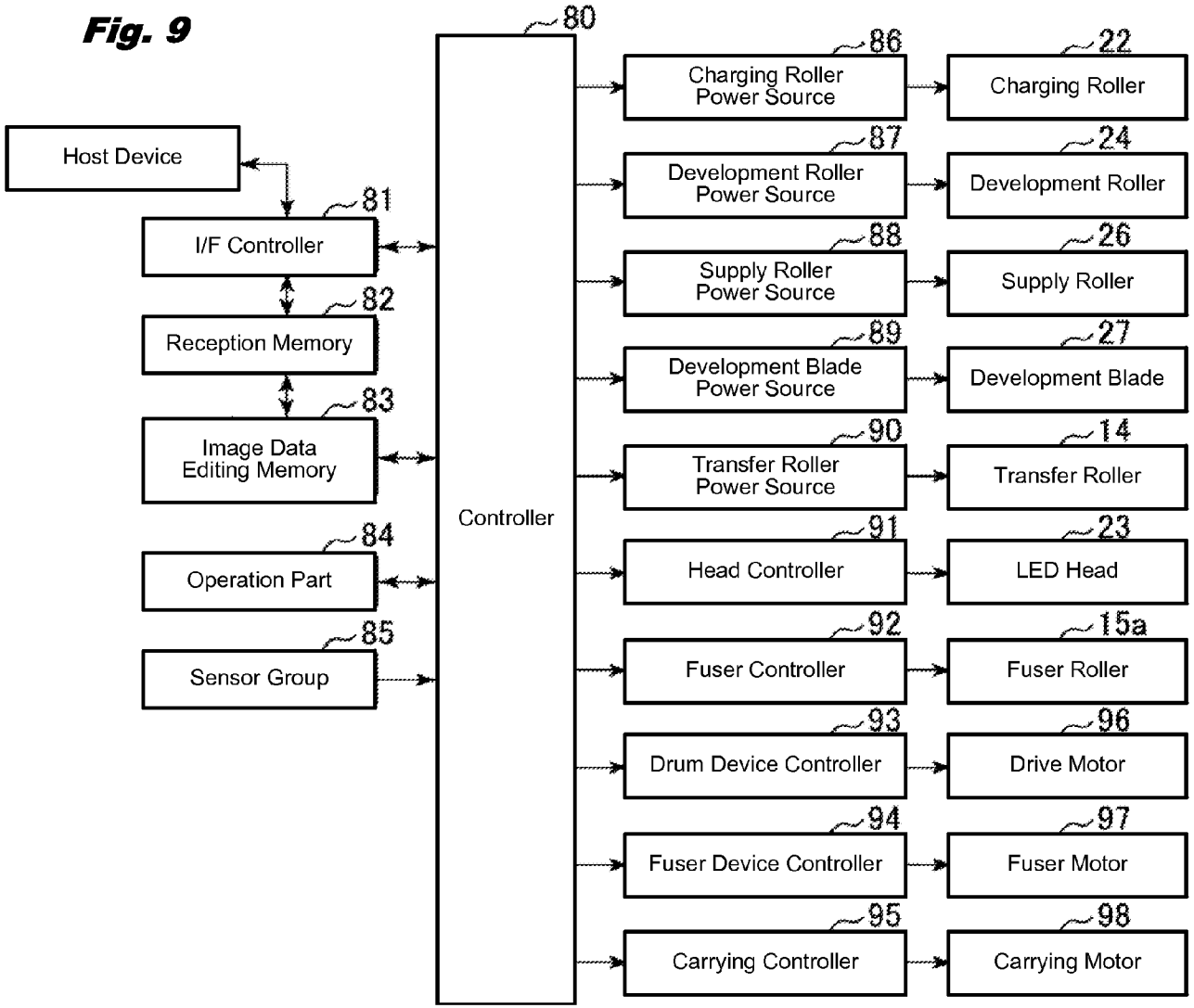
FIG. 9 illustrates a block diagram illustrating a control system of the image forming apparatus according to the first embodiment.

The image forming part 20 has a photosensitive drum 21 as an image carrier. The photosensitive drum 21 is obtained, for example, by forming a photosensitive layer on a surface of a metallic shaft. The photosensitive drum 21 rotates clockwise as indicated in FIG. 2 due to a drive force of a drive motor 96 (FIG. 9). The photosensitive layer of the photosensitive drum 21 is obtained by laminating a charge generation layer and a charge transportation layer, and can store charges. The charges attenuate due to exposure.

A charging roller 22 as a charging member, an LED (Light Emitting Diode) head 23 as an exposure part, a development roller 24 as a developer carrier, a transfer roller 14 as a transfer member, and a cleaning blade 28 as a cleaning member, are arranged around the photosensitive drum 21 along a rotation direction of the photosensitive drum 21.

The charging roller 22 is obtained, for example, by forming a conductive elastic layer on a surface of a metallic shaft. The charging roller 22 is in contact with a surface of the photosensitive drum 21 at a constant pressure, and rotates following the photosensitive drum 21. The charging roller 22 is applied with a charging voltage by a charging roller power source 86 (FIG. 9) and uniformly charges the surface of the photosensitive drum 21.

The LED head 23 is opposingly arranged above the photosensitive drum 21. The LED head 23, under control of a head controller 91 (FIG. 9), irradiates light to the surface of the photosensitive drum 21 according to image data, and forms an electrostatic latent image on the surface of the photosensitive drum 21. The LED head 23 is attached to an upper cover of the image forming apparatus 1.

The development roller 24 is obtained, for example, by forming a conductive elastic layer on a surface of a metallic shaft. The development roller 24 is in contact with the surface of the photosensitive drum 21 at a constant pressure, and rotates in a direction opposite to the rotation direction of the photosensitive drum 21 (that is, movement directions of surfaces at a contact part are the same). The development roller 24 is applied with a development voltage by a development roller power source 87 (FIG. 9), and develops the electrostatic latent image that is formed on the surface of the photosensitive drum 21 using a developer (toner).

The transfer roller 14 is obtained, for example, by forming a conductive elastic layer on a surface of a metallic shaft. The transfer roller 14 is arranged below the photosensitive drum 21 in such a manner that the recording medium P is sandwiched between the transfer roller 14 and the photosensitive drum 21. The transfer roller 14 is applied with a transfer voltage by a transfer roller power source 90 (FIG. 9), and transfers the developer image that is formed on the surface of the photosensitive drum 21 to the recording medium P.

The cleaning blade 28 is, for example, a rubber roller or blade and is in contact with the surface of the photosensitive drum 21 at a constant pressure. The cleaning blade 28 scrapes off developer that remains on the surface of the photosensitive drum 21 without being transferred to the recording medium. On a lower side of the cleaning blade 28, a a carrying spiral 29 is provided that carries the developer (waste developer) scraped off by the cleaning blade 28 to a side frame (not illustrated in the drawings) of the image forming unit 2.

Further, around the development roller 24, a supply roller 26 as a supply member and a development blade 27 as a layer regulation member are arranged. The supply roller 26 is obtained, for example, by forming a foamed elastic layer on a surface of a metallic shaft. The supply roller 26 is in contact with a surface of the development roller 24 at a constant pressure, and rotates in a direction same as a rotation direction of the development roller 24 (that is, movement directions of surfaces at a contact part are opposite to each other). The supply roller 26 is applied with a supply voltage by a supply roller power source 88, and attaches developer to the surface of the development roller 24.

The development blade 27 is obtained, for example, by bending a metallic plate member, and a bent part thereof is in contact with the surface of the development roller 24 at a constant pressure. The development blade 27 is applied with a voltage by a development blade power source 89 (FIG. 9). The development blade 27 regulates a thickness of a layer of the developer attached to the surface of the development roller 24 and thereby forms a developer thin layer (toner thin layer) of a constant thickness.

In the image forming part 20, a space on an upper side of the development roller 24 and the supply roller 26 configures a developer holding part 25 (toner hopper) that holds the developer. Developer (which is indicated using a reference numeral 4 in FIG. 2) is supplied to the developer holding part 25 from the developer container 3. A configuration of the developer container 3 is described in the following.

<Configuration of Developer Container>

Figure 3:
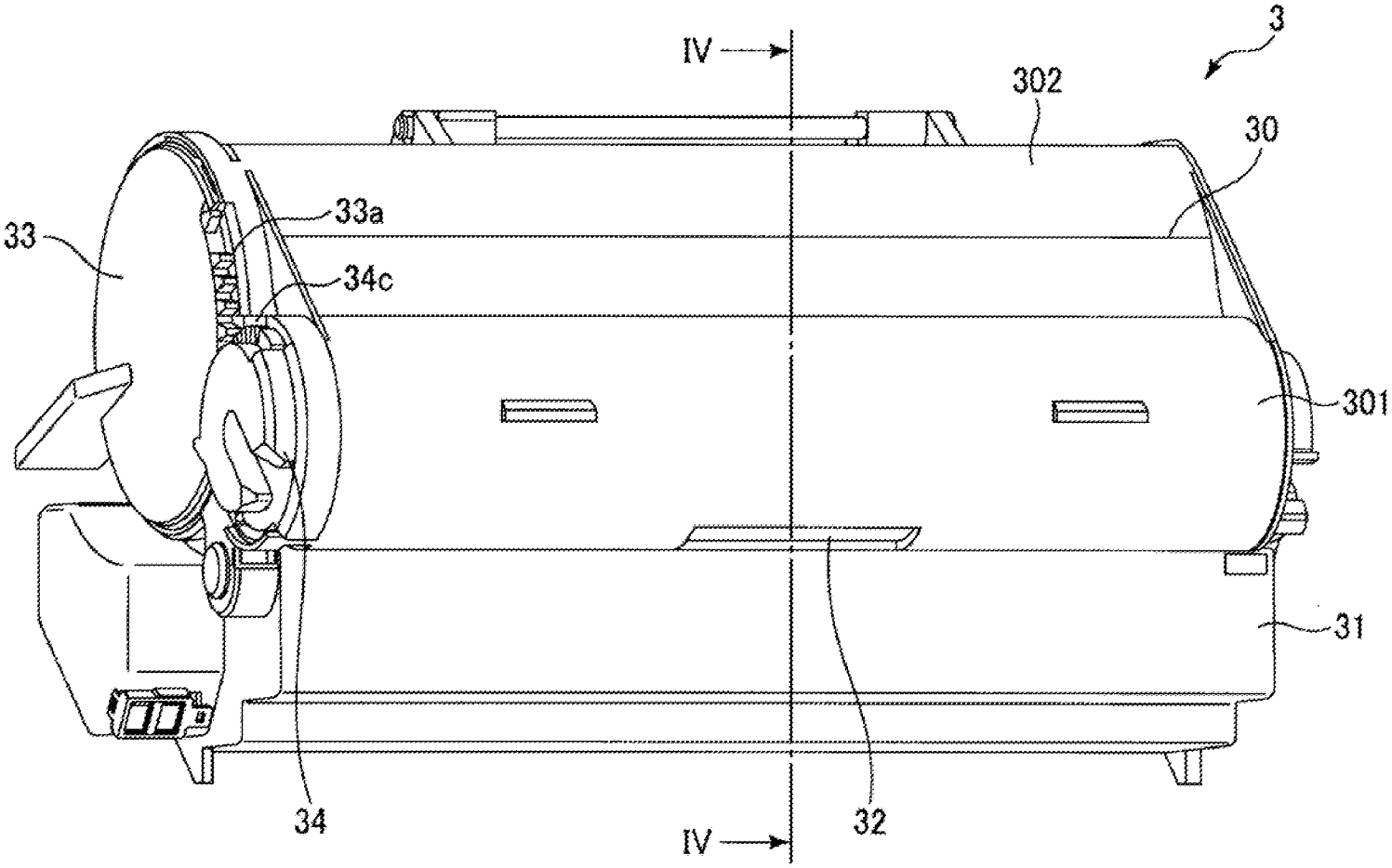
FIG. 3 illustrates a perspective view illustrating an external shape of a developer container according to the first embodiment.

FIG. 3 illustrates a perspective view illustrating an external shape of the developer container 3. The developer container 3 is also referred to as a developer cartridge (toner cartridge). The developer container 3 has a developer containing part 30 that contains unused developer and a waste developer containing part 31 that contains waste developer. Here, the waste developer containing part 31 is provided below the developer containing part 30.

The developer container 3 has a supply port 32 (outlet) for supplying the developer contained in the developer containing part 30 to the image forming part 20. The developer container 3 further has a lever part 33 that is operated by a user when the user uses the developer container 3, and a shutter 34 as an opening and closing member that opens and closes the supply port 32 in conjunction with the operation of the lever part 33.

Figure 4:
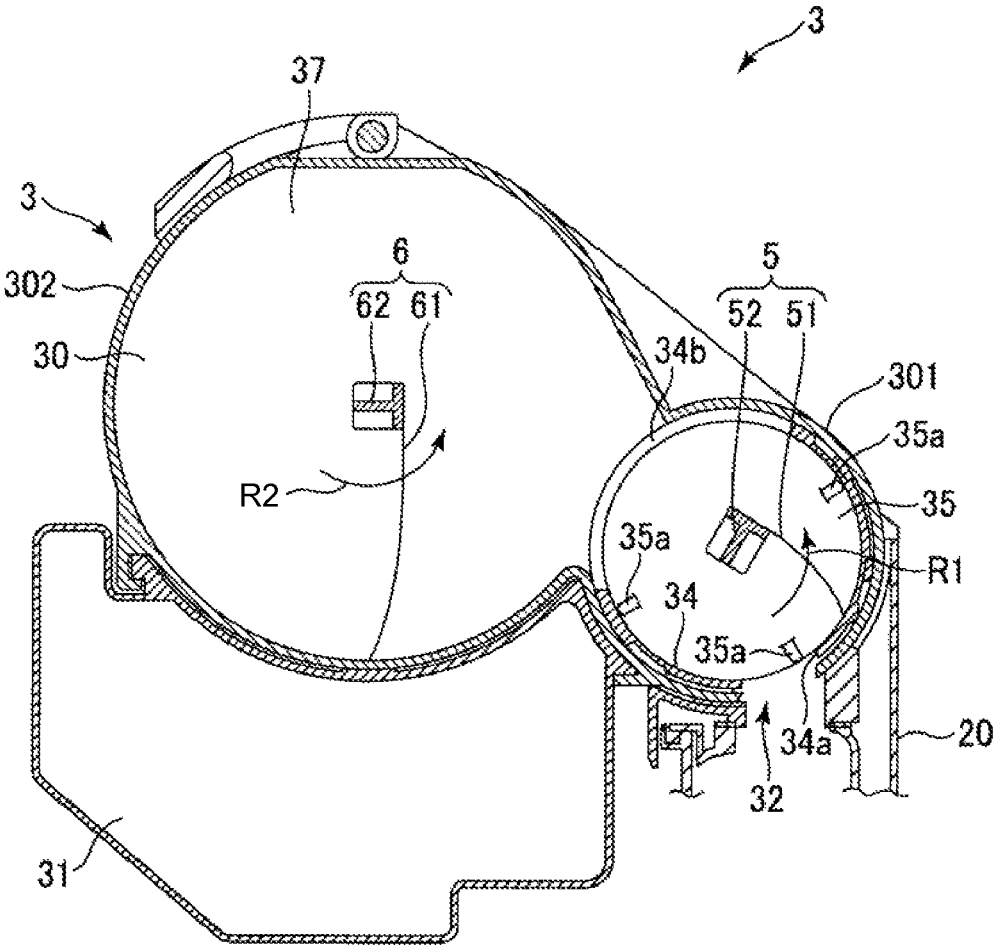
FIG. 4 illustrates a cross-sectional view in an arrow direction at a line IV-IV illustrated in FIG. 3.

FIG. 4 illustrates a cross-sectional view in an arrow direction at a line IV-IV illustrated in FIG. 3. A state illustrated in FIG. 4 is a state in which the developer container 3 is attached to the image forming part 20 and an image forming operation can be performed. The developer containing part 30, for example, has a shape of a combination of the first cylindrical part 301 and the second cylindrical part 302. The first cylindrical part 301 and the second cylindrical part 302 both have a substantially cylindrical shape.

Axial directions (longitudinal directions) of the first cylindrical part 301 and the second cylindrical part 302 are parallel to each other, and a size (inner diameter) of the second cylindrical part 302 is larger than that of the first cylindrical part 301. An interior space of the first cylindrical part 301 and an interior space of the second cylindrical part 302 are communicatively connected.

The second cylindrical part 302 is formed on an obliquely upper side of the first cylindrical part 301. That is, it is configured in such a manner that the developer contained in the second cylindrical part 302 moves to the first cylindrical part 301 due to gravity. The supply port 32 is formed at a bottom part of the first cylindrical part 301 and at a center in an axial direction of the first cylindrical part. Further, the waste developer containing part 31 is formed below the second cylindrical part 302 and on an obliquely lower side of the first cylindrical part 301.

The shutter 34 has a substantially cylindrical shape and is provided rotatable along an inner peripheral surface of the first cylindrical part 301. The shutter 34 has a shutter aperture 34*a* that overlaps with the supply port 32 at a predetermined rotation position. Further, the shutter 34 has an aperture part 34*b* that widely opens to the second cylindrical part 302 side. The developer in the second cylindrical part 302 moves through the aperture part 34*b* to an inner side region of the shutter 34 inside the first cylindrical part 301.

Further, as illustrated in FIG. 3, one end part of the shutter 34 in the axial direction protrudes to outside of the developer container 3. On the protruding end part of the shutter 34, a gear part 34*c* is provided that meshes with a gear part 33*a* that is provided on the lever part 33. Further, the lever part 33 is rotatably provided on an outer side of the developer container 3 (more specifically, on an outer side of the second cylindrical part 302). A user can rotate the shutter 34 by holding and rotating the lever part 33.

When a user rotates the shutter 34 so that the shutter aperture 34*a* and the supply port 32 overlap as illustrated in FIG. 4, the developer is supplied from the supply port 32 to the image forming part 20. On the other hand, when the shutter 34 is rotated from the rotation position illustrated in FIG. 4 so that the shutter aperture 34*a* and the supply port 32 are in a non-overlapping state, the supply port 32 is closed by the shutter 34.

Inside the first cylindrical part 301, an agitation member 5 is provided that agitates the developer. The agitation member 5 is rotatable about a rotation axis 5A (see FIG. 5) that is parallel to the axial direction of the first cylindrical part 301 (the longitudinal direction of the developer container 3). The agitation member 5 has an agitation film 51 as an agitation part and an agitation bar 52 as a support part (rotation part) that supports the agitation film 51. In the embodiments of the invention, the agitation member 5 and agitation bar 52 may be different parts, but may be integrally formed as a single part.

The rotation axis 5A of the agitation member 5 is positioned substantially at a center of the first cylindrical part 301 in a cross section orthogonal to the axial direction of the first cylindrical part 301. The agitation member 5 rotates in a direction indicated by an arrow R1 in FIG. 4 due to a drive force of the drive motor 96 (FIG. 9) that is a drive source.

The agitation film 51 is provided in such a manner that a distal edge thereof is in contact with an inner peripheral surface of the shutter 34. When the agitation member 5 rotates, the distal edge of the agitation film 51 slides against the inner peripheral surface of the shutter 34.

Inside the second cylindrical part 302, an agitation member 6 is provided that agitates the developer. The agitation member 6 is rotatable about a rotation axis that is parallel to the axial direction of the second cylindrical part 302 (the longitudinal direction of the developer container 3). The agitation member 6 has an agitation film 61 and an agitation bar 62 that supports the agitation film 61.

The rotation axis of the agitation member 6 is positioned substantially at a center of the second cylindrical part 302 in a cross section orthogonal to the axial direction of the second cylindrical part 302. The agitation member 6 rotates in a direction indicated by the arrow R2 in FIG. 4 due to a drive force of the drive motor 96 (FIG. 9) that is a drive source.

The agitation film 61 is provided in such a manner that a distal edge thereof is in contact with an inner peripheral surface of the second cylindrical part 302. When the agitation member 6 rotates, the distal edge of the agitation film 61 slides against the inner peripheral surface of the second cylindrical part 302.

Here, the agitation films 51, 61 are respectively fixed to the agitation bars 52, 62 by thermal caulking. However, fixation of the agitation films 51, 61 is not limited to using thermal caulking. For example, fixation by hooking with claws, fixation by sandwiching using a sandwiching member, and the like, may also be adopted.

On one end part of the first cylindrical part 301 in the axial direction, a side wall part 35 is formed. On the side wall part 35, a plurality of projection parts 35*a* projecting toward the inside of the first cylindrical part 301 are formed. Here, three projection parts 35*a* are formed on the side wall part 35. However, the number of the projection parts 35*a* may be less than three or may be four or more.

The projection parts 35*a* imparts vibration to the side wall part 35 by being in contact with the agitation film 51 as will be described later. It is desirable that at least one of the projection parts 35*a* be arranged at a position opposing the supply port 32 in the cross section (FIG. 4) orthogonal to the rotation axis 5A of the agitation member 5. This is because developer shaken off from the side wall part 35 due to the contact between the agitation film 51 and the projection parts 35*a* is efficiently guided to the supply port 32.

Basically, a projection part 35*a* can be arranged at any place on the side wall part 35. In a view of effectively providing the vibration, a peripheral side is preferred to the rotational axis of the side wall part 35. In FIG. 4, three projection parts 35*a* are arranged on the peripheral, which is on a single circle around the rotational axis. However, one or two of the multiple projection parts 35*a* may be arranged on difference concentric circles around the rotational axis, which are inside the peripheral.

Figure 5:
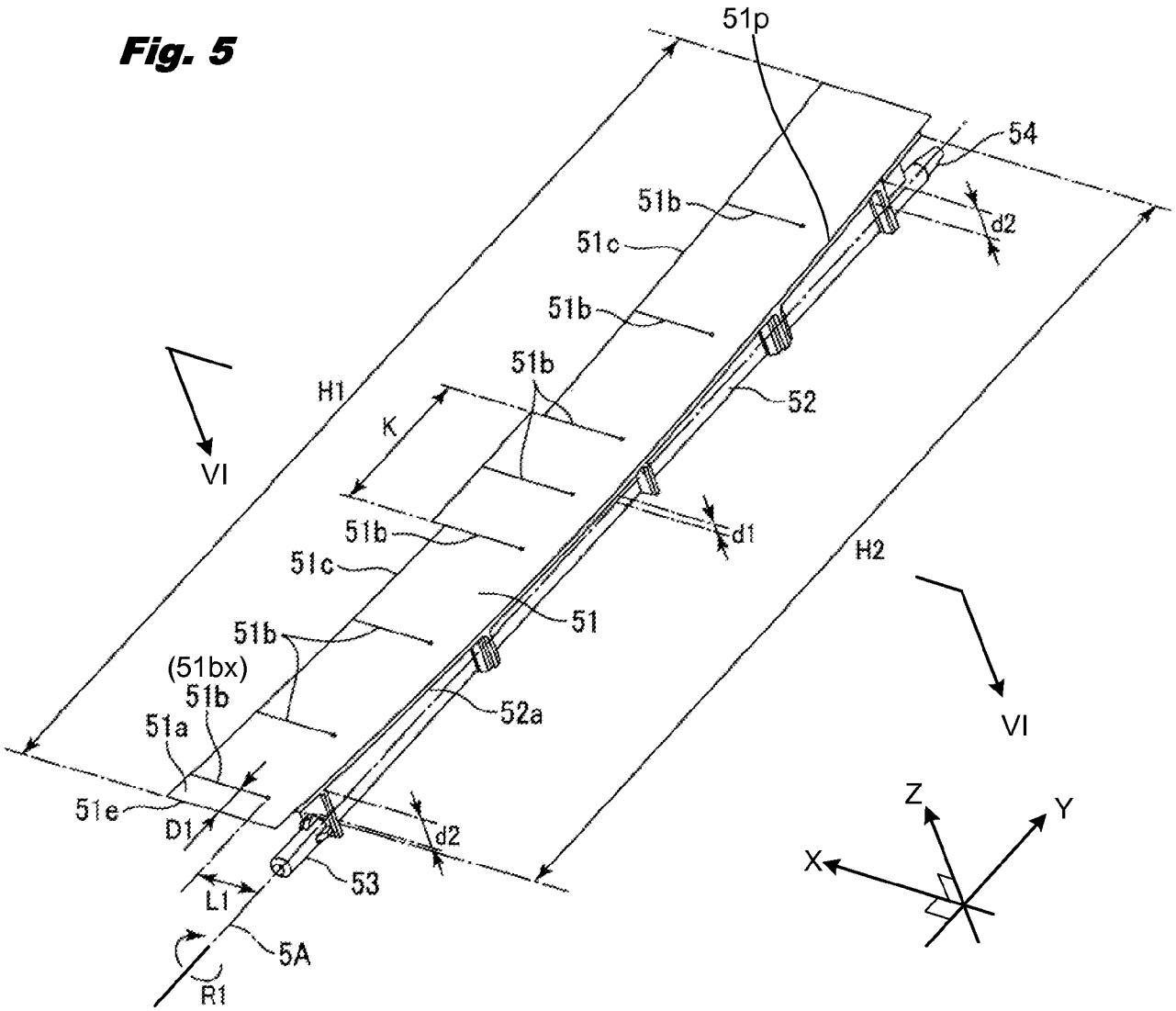
FIG. 5 illustrates a perspective view illustrating a shape of an agitation member according to the first embodiment.
Figure 6A:
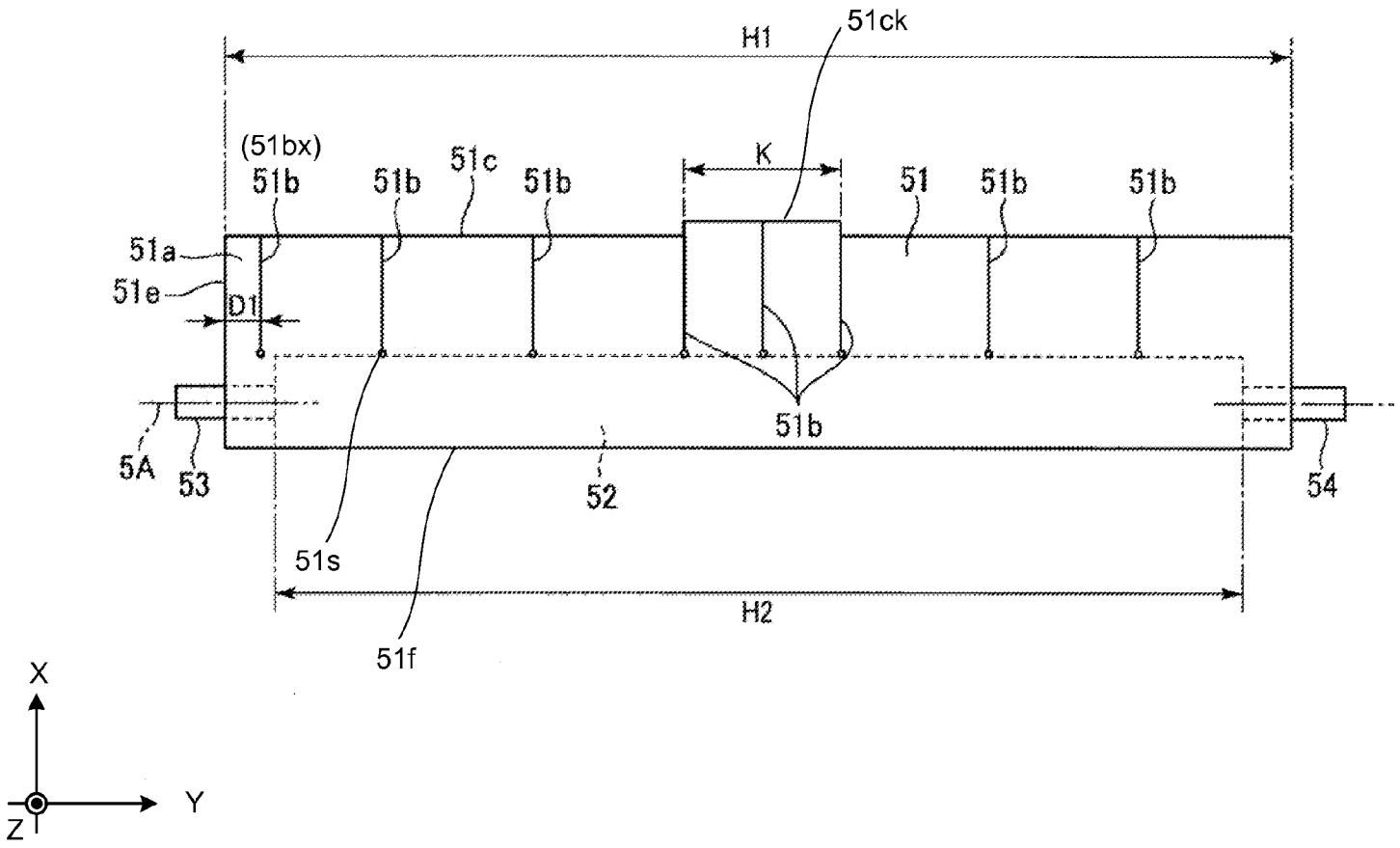
FIG. 6A illustrates a schematic diagram illustrating a schematic shape of the agitation member according to the first embodiment.

Further, on one end part of the second cylindrical part 302 in the axial direction, a side wall part 37 is formed. Here, on the side wall part 37, projection parts are not provided. However, projection parts similar to the projection parts 35*a* may be provided FIG. 5 illustrates a perspective view illustrating a shape of the agitation member 5 according to the first embodiment. FIG. 6A illustrates schematic diagram illustrating a schematic shape of the agitation member 5 viewed from direction indicated by an arrow VI in FIG. 5. The agitation member 5 has the above-described agitation film 51, the agitation bar 52 and shaft parts 53, 54.

A central axis of the agitation bar 52 coincides with the rotation axis 5A. The agitation bar 52 is an elongated member that is long in the rotating axis (Y-direction). On two ends of the agitation bar 52 in the longitudinal direction, shaft parts 53, 54 that define the rotation axis 5A are mutually coaxially formed.

An attachment part 52*a* for attaching the agitation film 51 is formed along the longitudinal direction of the agitation bar 52. The attachment part 52*a* has inclinations such that a central part of the attachment part 52*a* in the longitudinal direction of the agitation bar 52 is closest to the rotation axis 5A and the attachment part 52*a* becomes increasingly separated away from the rotation axis 5A with approaching two end parts of the agitation bar 52 from the central part in the longitudinal direction. In other words, the attachment part 52*a* is formed in such a manner that a distance d1 between the attachment part 52*a* and the rotation axis 5A at the central part of the agitation bar 52 in the longitudinal direction is shorter than a distance d2 between the attachment part 52*a* and the rotation axis 5A at the two ends of the agitation bar 52 in the longitudinal direction. It is preferred that a ratio of d1/d2 satisfies follow:

$$1<d1/d2\leq 2.$$

The distances d1 and d2 are lengths in Z direction in FIG. 5.

The agitation film 51 is attached to a surface (attachment surface) of the attachment part 52*a* of the agitation bar 52. The agitation film 51 is an elastically deformable member and is desirably made of a flexible material such as polyester or polyethylene terephthalate. Further, it is desirable that the agitation film 51 have a thickness in a range of 0.05-0.20 mm.

In the embodiment, the agitation film 51 is rectangle having two side edges 51*e* and two longitudinal edges (51*c* and 51*f*) that are longer than the side edges 51*e*.

Figure 6B:
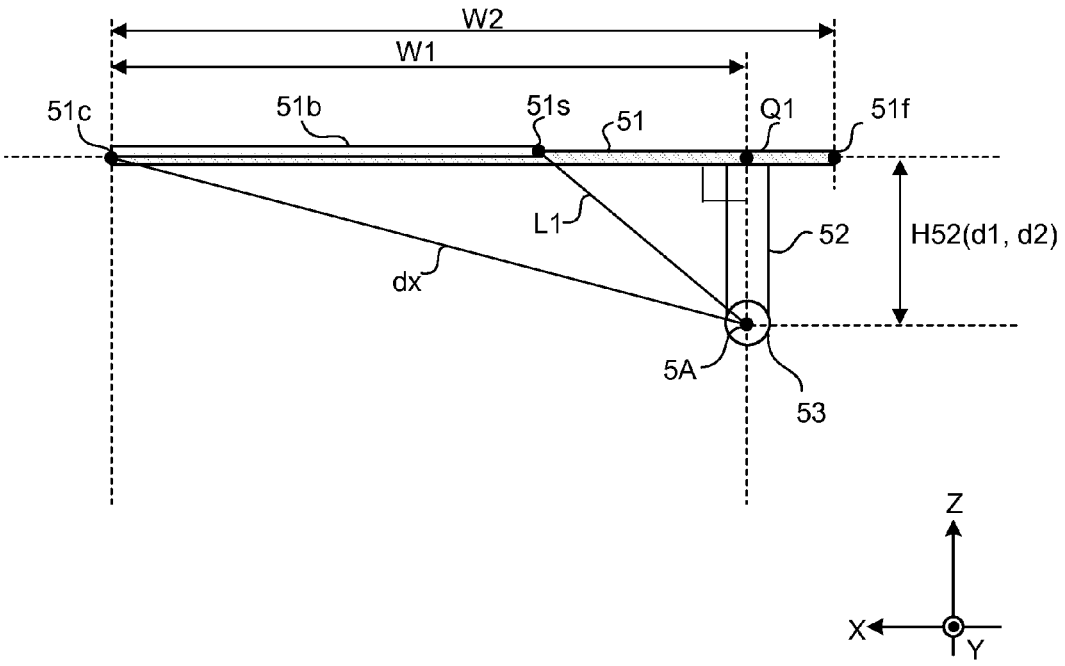
FIG. 6B illustrates a side view of an agitation film and an agitation bar on which the agitation film is attached.

As illustrated in FIG. 6B, the agitation film 51 and the agitation bar 52 are connected at a right angle in view of Y direction. The agitation film 51 is poised in X-direction. The agitation bar 52 stands up right in Z direction. One longitudinal edge of the agitation film 51, which is close to the agitation bar 52, is a proximal edge 51*f*. The other longitudinal edge, which is far from the agitation bar 52, is a distal edge 51*c*. A distance dx from the rotation shaft 5A to the distal edge 51*c* is determined using a height H52 of the agitation bar 52 and a projection length W1, which is measured from point Q1 to the distal edge 51*c* in X-direction. A whole length of agitation film 51 in X direction is denoted with W2. As illustrated in FIG. 5, the height H52 is not necessarily consistent along the rotation axis 5A. At the center, it is d1, which is shorter than d2 at the side. As a design matter, the connecting angle between the agitation film 51 and the agitation bar 52 is may vary. The slit arranged in the agitation film 51 is illustrated as a thin box above the agitation film 51 denoted with 51*b*. The end of the slit is denoted with 51*s*. Preferred length (or position of the slit end 51*s* may vary considering characteristics of the agitation film 51, or friction force generated between the agitation film 51 and the surrounding walls.

The distance dx from the rotation axis 5A to a distal edge 51*c* of the agitation film 51 is larger than a distance from the rotation axis 5A to the inner peripheral surface of the shutter 34. Therefore, the distal edge 51*c* of the agitation film 51 is in contact with the inner peripheral surface of the shutter 34. Further, when the agitation bar 52 rotates, the agitation film 51 is in a bent state (see FIG. 4) in which the distal edge 51*c* slides against the inner peripheral surface of the shutter 34 so that the distal edge 51*c* scrapes toners residing on the inner peripheral surface of the shutter 34.

Further, the attachment part 52*a* of the agitation bar 52 has the above-described inclinations (such that the central part of the attachment part 52*a* in the longitudinal direction is closest to the rotation axis 5A and the attachment part 52*a* becomes increasingly separated away from the rotation axis 5A with decreasing distance from the two ends). Therefore, the agitation film 51 rotates in such a manner that the two ends in the longitudinal direction move ahead of the central part in the rotation direction (arrow R1). Due to such rotation, the agitation film 51 is likely to carry the developer toward the center in the longitudinal direction (that is, toward the shutter aperture 34*a* and the supply port 32).

In the embodiment, edge shapes of the distal edge 51*c* and the proximal edge 51*f*, which is opposite to the distal edge 51*c*, are straight before the agitation film 51 is attached to the agitation bar 52, but become curved after being attached because the attachment part 52*a* of the agitation bar 52 is curved, to which the proximal edge 51*f* is attached. These parts 51*c* and 51*f* are not limited to be straight. When the attachment part 52*a* is straight, the distal edge 51*c* may be formed in a curved shape. Also, thickness and hardness of the agitation film 51 may vary along the rotation axis 5A.

Further, in a predetermined region K of the central part of the agitation film 51 in the longitudinal direction, the distal edge 51*c* of the agitation film 51 protrudes more than other regions. The distal edge in region K is donated with 51*c* k. Therefore, in the region K, the agitation film 51 is in a most bent state and slides against the inner peripheral surface of the shutter 34.

As illustrated in FIG. 6A, when a length of the agitation film 51 in a direction of the rotation axis 5A is H1 and a length of the attachment part 52*a* of the agitation bar 52 in the same direction is H2, H1>H2 holds. That is, in the direction of the rotation axis 5A, the agitation film 51 protrudes more than the attachment part 52*a* of the agitation bar 52, and the protruding portion comes into contact with the projection parts 35*a* of the side wall part 35. Further, the agitation film 51 also protrudes more than the attachment part 52*a* of the agitation bar 52 in a direction orthogonal to the rotation axis 5A.

A plurality of slits 51*b* (incisions) are provided in the agitation film 51. Each of the slits 51*b* extends in the direction orthogonal to the rotation axis 5A. In an example illustrated in FIG. 5, eight slits 51*b* are formed in the agitation film 51. However, the number of the slits 51*b* is not limited to eight.

A portion of the agitation film 51 between one side edge 51*e* (hereinafter referred to as the side edge 51*e*) in the longitudinal direction and a slit 51*b* closest to the side edge 51*e* configures a strip part 51*a*, which has a nearly strip card shape. The strip part 51*a* of the agitation film 51 protrudes beyond the side edge of the attachment part 52*a* of the agitation bar 52 in the direction of the rotation axis 5A.

Figure 7:
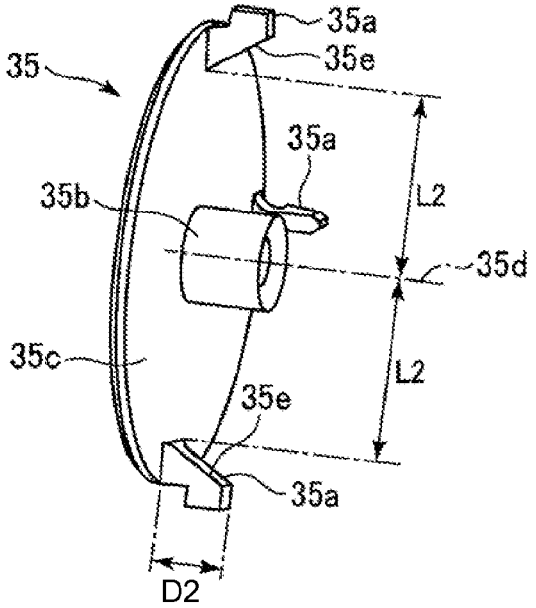
FIG. 7 illustrates a perspective view illustrating a shape of a side wall part of the developer container according to the first embodiment.

FIG. 7 illustrates a perspective view illustrating the side wall part 35 that is formed of the one end part of the first cylindrical part 301 in the axial direction. On the side wall part 35, the plurality of the projection parts 35*a* projecting toward the inside of the first cylindrical part 301 are formed. Here, on the side wall part 35, three projection parts 35*a* are formed along the rotation direction around the rotation axis 5A. However, the number of the projection parts 35*a* may be less than three or may be four or more. The side wall part 35 has a substantially circular shape. The above-described projection parts 35*a* are arranged along an outer periphery of the side wall part 35.

At a center of the side wall part 35, a bearing part 35*b* projecting toward the inside of the first cylindrical part 301 is formed. The bearing part 35*b* engages with the shaft part 53 of the agitation member 5 and rotatably supports the shaft part 53. A central axis 35*d* of the bearing part 35*b* coincides with the rotation axis 5A of the agitation member 5.

A reference numeral symbol 35*c* indicates a wall surface of the side wall part 35, that is, a surface facing the inside of the first cylindrical part 301 (inside of the developer containing part 30). A length D2 from the wall surface 35*c* of the side wall part 35 to a front end of a projection part 35*a* is substantially the same for each of the projection parts 35*a*.

Each of the projection parts 35*a* has a sloped surface 35*e* on the rotation axis 5A side thereof. The sloped surface 35*e* has such a slope of which an amount of projection toward the inside of the first cylindrical part 301 (inside of the developer containing part 30) increases as the distance from the central axis 35*d* (rotation axis 5A) increases. This is in order to reduce a load applied to the agitation film 51 when the projection parts 35*a* and the agitation film 51 are in contact with each other.

Figure 8:
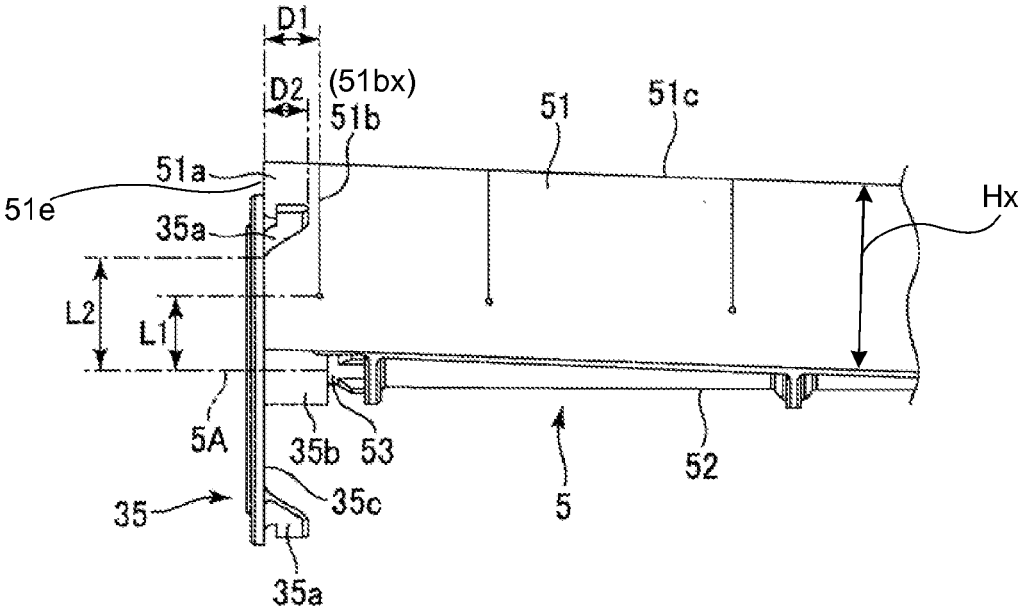
FIG. 8 illustrates a positional relation between the agitation member and the side wall part according to the first embodiment.

FIG. 8 illustrates a positional relation between the agitation member 5 and the side wall part 35. For the convenience of explanation, other members of the developer container 3 are omitted. The shaft part 53 of the agitation member 5 engages with the bearing part 35*b* of the side wall part 35. Also on a side wall part 36 (see FIG. 10) that opposes the side wall part 35 of the first cylindrical part 301, a bearing part 36*b* similar to the bearing part 35*b* is provided, and the shaft parts 53, 54 of the agitation member 5 are rotatably supported.

In FIG. 8, the strip part 51*a* of the agitation film 51 is in contact with the side wall part 35. It is desirable that a length (distance from the side edge 51*e* to the slit 51*b*) D1 of the strip part 51*a* of the agitation film 51 in the direction of the rotation axis 5A and the length (distance from the wall surface 35*c* to the front end of the projection parts 35*a*) D2 of the projection parts 35*a* of the side wall part 35 in the same direction satisfy the relation D1>D2. The is in order to suppress an increase in a rotational load of the agitation member 5 while achieving an effect of shaking off the developer from the side wall part 35 by the contact between the agitation film 51 and the projection parts 35*a*.

More specifically, it is desirable that $D2<D1\leq1.5\times D2$ be satisfied. Here, $D1=1.2\times D2$.

Further, it is desirable that a distance L1 (FIG. 5, FIG. 6B), which is from the rotation axis 5A of the agitation member 5 to an end (or slit end 51*s*) of the slits 51*b* and a distance L2 (FIG. 7), which is from the central axis 35*d* of the side wall part 35 to a base of each of the projection parts 35*a* satisfy the relation $L1<L2$. The is in order to suppress an increase in a rotational load of the agitation member 5 while achieving an effect of shaking off the developer from the side wall part 35 by the contact between the agitation film 51 and the projection parts 35*a*.

More specifically, it is desirable that $1.3\times L1\leq L2\leq1.8\times L1$ be satisfied. Here, $L2=1.5\times L1$. Among slits 51*b*, the slit which is the closest to the side wall part 35 is referred with 51*bx* in FIGS. 5, 6, 8 and 10.

<Control System of Image Forming Apparatus>

Next, a control system of the image forming apparatus 1 is described. FIG. 9 illustrates a block diagram illustrating the control system of the image forming apparatus 1. The image forming apparatus 1 includes a controller 80, an I/F (interface) controller 81, a reception memory 82, an image data editing memory 83, an operation part 84, a sensor group 85, a charging roller power source 86, a development roller power source 87, a supply roller power source 88, a development blade power source 89, a transfer roller power source 90, a head controller 91, a fuser controller 92, a drum drive controller 93, a fuser drive controller 94, a carrying controller 95, a drive motor 96, a fuser motor 97, and a carrying motor 98.

The controller 80 has a microprocessor, a ROM (Read Only Memory), a RAM (Random Access Memory), an Input/Output port, a timer, and the like. The controller 80 receives print data and a control command from a host device such as a personal computer via the I/F controller 81, and performs an image forming operation of the image forming apparatus 1.

The reception memory 82 temporarily stores print data input from the host device via the I/F controller 81. The image data editing memory 83 receives the print data stored in the reception memory 82 and stores the image data (or image data) that are formed by subjecting the print data to an editing process.

The operation part 84 includes a display for displaying a state of the image forming apparatus 1, and an operation part that allows an operator to input an instruction. The sensor group 85 includes various kinds of sensors for monitoring an operation state of the image forming apparatus 1 such as a medium position sensor that detects a position of the recording medium P and a temperature and humidity sensor.

The charging roller power source 86 applies a charging voltage to the charging roller 22 for uniformly charging the surface of the photosensitive drum 21. The development roller power source 87 applies a development voltage to the development roller 24 for developing an electrostatic latent image on the surface of the photosensitive drum 21.

The supply roller power source 88 applies a supply voltage to the supply roller 26 for supplying developer to the development roller 24. The development blade power source 89 supplies a voltage to the development blade 27 for forming a developer thin layer on the development roller 24. The transfer roller power source 90 applies a transfer voltage to the transfer roller 14 for transferring a developer image on the photosensitive drum 21 to the recording medium P.

The head controller 91 controls light emission of the LED head 23 based in the image data recorded in the image data editing memory 83.

The fuser controller 92 has a temperature adjustment circuit and supplies a predetermined current to a heater of the fuser roller 15*a* based on an output signal of a temperature sensor (such as a thermistor) provided in the fuser unit 15.

The drum drive controller 93 controls rotation of the drive motor 96 (drum drive motor, also referred to as an ID motor) for rotating the photosensitive drum 21, the development roller 24, the supply roller 26 and the like. The agitation members 5, 6 of the developer container 3 rotate due to rotation transmission of the drive motor 96.

The fuser drive controller 94 controls rotation of the fuser motor 97 for rotating the fuser roller 15*a* of the fuser unit 15. The ejection roller 16*a* and the ejection roller 17*a* also rotate due to rotation transmission from the fuser motor 97.

The carrying controller 95 controls rotation of the carrying motor 98 for rotating the sheet feeding roller 12 and the carrying roller 13*a* that carry the recording medium.

<Basic Operation of Image Forming Apparatus>

An basic operation of the image forming apparatus 1 that is configured as described above is as follows. First, when a print command and print data are received from a host device via the I/F controller 81, the controller 80 of the image forming apparatus 1 starts an image forming operation. The controller 80 temporarily records the print data in the reception memory 82, subjects the recorded print data to an editing process to generate image data, and records the image data in the image data editing memory 83.

The controller 80 further drives the carrying motor 98 via the carrying controller 95. As a result, the sheet feeding roller 12 rotates, and feeds one by one the recording medium P contained in the medium cassette 11 to the carrying route 40. Further, the pair of the carrying rollers 13*a*, 13*b* rotate and carry the recording medium P along the carrying route 40 toward the image forming unit 2.

The controller 80 further performs formation of a developer image in the image forming unit 2. That is, the controller 80 respectively applies voltages to the charging roller 22, the development roller 24, the supply roller 26 and the development blade 27 from the charging roller power source 86, the development roller power source 87, the supply roller power source 88 and the blade power source 89.

The controller 80 further rotates the drive motor 96 via the drum drive controller 93 to rotate the photosensitive drum 21. Along with the rotation of the photosensitive drum 21, the charging roller 22, the development roller 24, the supply roller 26 and the agitation members 5, 6 also rotate. The charging roller 22 uniformly charges the surface of the photosensitive drum 21.

The controller 80 transmits the image data recorded in the image data editing memory 83 to the head controller 91. The head controller 91 causes the LED head 23 to emit light according to the image data to expose the surface of the photosensitive drum 21 to form an electrostatic latent image.

In the developer holding part 25 of the image forming unit 2, developer supplied from the developer container 3 is held. The developer in the developer holding part 25 is supplied by the supply roller 26 to the development roller 24 and is attached to the surface of the development roller 24. The developer attached to the surface of the development roller 24 is regulated by the development blade 27 to have a constant thickness and forms a developer thin layer (toner thin layer).

The electrostatic latent image that is formed on the surface of the photosensitive drum 21 is developed by the developer attached to the development roller 24, and a developer image is formed on the surface of the photosensitive drum 21. At a timing when the developer image on the surface of the photosensitive drum 21 reaches a nip part between the photosensitive drum 21 and the charging roller 22, a leading edge of the recording medium reaches the nip part. The controller 80 applies a transfer voltage from the transfer roller power source 90 to the transfer roller 14 so that the developer image is transferred from the photosensitive drum 21 to the recording medium.

The recording medium P to which the developer image has been transferred is further carried by the rotations of the photosensitive drum 21 and the transfer roller 14, and reaches the fuser unit 15. In the fuser unit 15, the fuser roller 15*a* and the pressure application roller 15*b* have already been rotating, and a surface temperature of the fuser roller 15*a* has reached a predetermined fusing temperature under the control of the fuser controller 92. The recording medium P is heated and pressed by the fuser roller 15*a* and the pressure application roller 15*b*, and the developer image is fused on the recording medium P.

The recording medium P on which the developer image has been fused is carried by the pair of the ejection rollers 16*a*, 16*b* toward the ejection port 18, and is ejected to the outside by the pair of the ejection rollers 17*a*, 17*b* from the ejection port 18. The ejected recording medium P is stacked on the stacker part 19. As a result, the image formation is completed.

Further, developer (waste developer) that is not transferred to the recording medium P is scraped off by the cleaning blade 28 and is carried by the carrying spiral 29 to the side frame of the image forming unit 2, and is stored in the waste developer containing part 31 (FIG. 4) of the developer container 3.

<Operation of Developer Container>

An operation of the developer container 3 is described with reference to FIG. 4. In the developer containing part 30 of the developer container 3, due to a drive force of the drive motor 96, the agitation member 5 inside the first cylindrical part 301 and the agitation member 6 inside the second cylindrical part 302 respectively rotate in directions indicated by the arrows R1, R2.

When the agitation member 5 rotates in the R1 direction, the agitation film 51 rotates while being in contact with the inner peripheral surface of the shutter 34, and scrapes off the developer attached to the inner peripheral surface of the shutter 34. When the agitation member 6 rotates in the R2 direction, the agitation film 61 rotates while being in contact with the inner peripheral surface of the second cylindrical part 302, and scrapes off the developer attached to the inner peripheral surface of the second cylindrical part 302.

The developer that is scraped off by the agitation film 51 from the inner peripheral surface of the shutter 34 is carried toward the shutter aperture 34*a* that is arranged as the center of the shutter 34 because of the above-described inclinations of the agitation film 51 (the inclinations in which the two end parts in the longitudinal direction move ahead of the central part in the rotation direction).

The developer that has reached the shutter aperture 34*a* of the shutter 34 is supplied via the shutter aperture 34*a* and the supply port 32 to the developer holding part 25 of the image forming part 20, and is used in the above-described development of the electrostatic latent image.

<Operation of Agitation Member>

Next, an operation of the agitation member 5 is described with reference to FIG. 8. When the agitation member 5 rotates in the R1 direction, the agitation film 51 and the plurality of the projection parts 35*a* of the side wall part 35 repeatedly come into contact (collide) with each other. Due to the contact between the agitation film 51 and the projection parts 35*a*, vibration is imparted to the side wall part 35. Due to the vibration of the side wall part 35, the developer that is attached to the wall surface 35*c* of the side wall part 35 (that is, the developer that cannot be scraped off by the contact of the agitation film 51 alone) can be shaken off.

The developer that has been shaken off is carried by the agitation film 51 toward the shutter aperture 34*a* and is supplied via the supply port 32 to the image forming part 20. As a result, the developer remaining inside the developer containing part 30 can be reduced and the developer can be efficiently supplied to the image forming part 20.

In the present embodiment, in the agitation film 51, the end part that is in contact with the projection parts 35*a* of the side wall part 35 is the strip part 51*a*. The strip part 51*a* is separated by the slit 51*b* from other portions of the agitation film 51 and can be independently bent. Therefore, as compared to a configuration in which the entire agitation film 51 is bent due to being in contact with the projection parts 35*a*, an increase in a load of the drive motor 96 that is a drive source of the agitation member 5 can be suppressed.

Here, in a case where the length D1 of the strip part 51*a* of the agitation film 51 in the direction of the rotation axis 5A is less than the length (an amount of projection from the wall surface 35*c*) D2 of the projection parts 35*a* of the side wall part 35 in the same direction (that is, in a case where D1<D2 holds), the entire agitation film 51 is affected by the contact between the projection parts 35*a* and the agitation film 51 and thus the load of the drive motor 96 increases.

On the other hand, in a case where the length D1 of the strip part 51*a* of the agitation film 51 in the direction of the rotation axis 5A is greater than 1.5 times of the length D2 of the projection parts 35*a* of the side wall part 35 in the same direction (that is, in a case where D1>1.5×D2 holds), the vibration imparted to the side wall part 35 by the contact between the agitation film 51 and the projection parts 35*a* is reduced and thus the effect of shaking off the developer attached to the side wall part 35 is reduced.

Therefore, it is desirable that the length D1 of the strip part 51*a* of the agitation film 51 in the direction of the rotation axis 5A and the length D2 of the projection parts 35*a* of the side wall part 35 in the same direction satisfy D2≤D1≤1.5×D2. The numerical value of 1.5 is experimentally obtained.

Further, in a case where the distance L2 (FIG. 7) from the central axis 35*d* of the side wall part 35 to the base of one (or any) of the projection parts 35*a* is less than 1.3 times of the distance L1 (FIG. 5) from the rotation axis 5A of the agitation member 5 to the slit end 51*s* of the slit 51*b* (more specifically 51*bx*) of the agitation film 51 (that is, L2<1.3×L1), the agitation film 51 is entirely affected by the contact between the projection parts 35*a* and the agitation film 51 and thus the load of the drive motor 96 increases.

On the other hand, in a case where the distance L2 from the central axis 35*d* of the side wall part 35 to the base of one (or any) of the projection parts 35*a* is greater than 1.8 times of the distance L1 from the rotation axis 5A of the agitation member 5 to the slit end 51*s* of the slit 51*b* (51*bx*) of the agitation film 51 (that is, L2>1.8×L1), the vibration imparted to the side wall part 35 by the contact between the agitation film 51 and the projection parts 35*a* is reduced and thus the effect of shaking off the developer attached to the side wall part 35 is reduced.

Therefore, it is desirable that the distance L1 from the rotation axis 5A of the agitation member 5 to each of the slits 51*b* and the distance L2 from the central axis 35*d* of the side wall part 35 to the base of each of the projection parts 35*a* satisfy 1.3×L1≤L2≤1.8×L1. The numerical values of 1.3 and 1.8 are both experimentally obtained.

Further, in the present embodiment, in the direction of the rotation axis 5A, the agitation film 51 protrudes more than the agitation bar 52, and the protruding portion (the strip part 51*a*) is in contact with the projection parts 35*a*. Therefore, it is possible that only the agitation film 51 is bent, and an increase in the load of the drive motor 96 can be suppressed.

Further, by adopting a configuration in which the agitation film 51 protrudes more than the agitation bar 52 in the direction of the rotation axis 5A and the protruding portion is on contact with the projection parts 35*a*, it is possible that only the agitation film 51 is bent, and an increase in the load of the drive motor 96 can be suppressed.

Further, the projection parts 35*a* each have the sloped surface 35*e* (FIG. 7), and thereby the agitation film 51 can smoothly deform along the sloped surface 35*e* when coming into contact with the projection parts 35*a*. Therefore, a load applied to the agitation film 51 can be reduced and damage can be prevented.

By arranging at least one of the plurality of the projection parts 35*a* of the side wall part 35 at a position opposing the supply port 32 in a cross section (FIG. 4) orthogonal to the rotation axis 5A of the agitation member 5, the developer that is shaken off from the side wall part 35 sue to the contact between the agitation film 51 and the projection parts 35*a* can be efficiently carried by the agitation film 51 to the shutter aperture 34*a* (supply port 32).

Effect of Embodiment

As described above, in the first embodiment of the present invention, by bringing the agitation film 51 of the agitation member 5 into contact with the projection parts 35*a* of the side wall part 35, vibration is imparted to the side wall part 35 and due to the vibration, the developer attached to the wall surface 35*c* of the side wall part 35 can be shaken off. Therefore, the developer remaining inside the developer container 3 can be reduced and the developer can be efficiently supplied.

Further, by adopting the configuration in which the strip part 51*a* of the end part of the agitation film 51 is bent when the agitation film 51 is in contact with the projection parts 35*a* of the side wall part 35, an increase in the load of the drive motor 96 that is the drive source of the agitation member 5 can be suppressed.

Modified Embodiments

Figure 10:
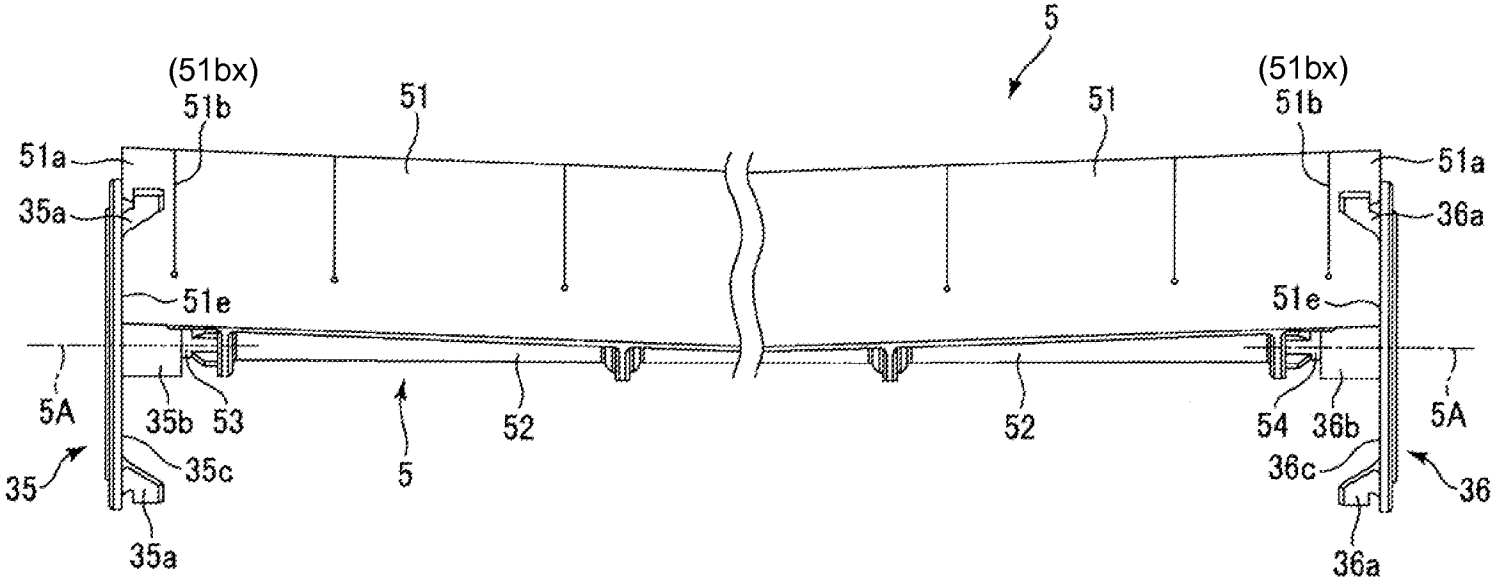
FIG. 10 illustrates a positional relation between an agitation member and a side wall part according to a modified embodiment of the first embodiment.

In the above embodiment, the projection parts 35*a* are provided on the side wall part 35 on one end of the developer container 3 in the longitudinal direction. However, it is also possible that projection parts 35*a*, 36*a* are provided on side wall parts 35, 36 on both ends of the developer container 3 in the longitudinal direction. FIG. 10 illustrates a modified embodiment in which the projection parts 35*a*, 36*a* are provided on the side wall parts 35, 36 of the developer container 3.

In FIG. 10, the side wall part 36 has a shape symmetrical to that of the side wall part 35 with respect to the center of the developer container 3 in the longitudinal direction. That is, the side wall part 36 has the bearing part 36*b* that supports the shaft part 54 of the agitation member 5, a wall surface 36*c* that faces the inside of the developer containing part 30, and the projection parts 36*a* that project toward the inside of the developer containing part 30.

The projection parts 35*a*, 36*a* are respectively provided on both side wall parts 35, 36. Therefore, the agitation film 51 is in contact with the projection parts 35*a*, 36*a* and vibration is imparted to both side wall parts 35, 36 so that the effect of shaking off the developer can be further enhanced.

In this case, it is desirable that the strip part 51*a* be provided on each of both sides of the agitation film 51 in the longitudinal direction. In this way, only the strip parts 51*a* of the both end parts of the agitation film 51 are bent when the agitation film 51 is in contact with the projection parts 35*a*, 36*a*. Therefore, an increase in the load of the drive motor 96 that is the drive source of the agitation member 5 can be suppressed.

Further, in the above embodiment, the projection parts 35*a* are provided on the side wall part 35 of the cylindrical part 301, among the two cylindrical parts 301, 302 of the developer container 3. However, it is also possible that projection parts are further provided on the side wall part 37 (FIG. 4) of the cylindrical part 302. According to such a configuration, by the contact between the agitation film 61 (FIG. 4) of the agitation member 6 and the projection parts of the side wall part 37 of the cylindrical part 302, the developer attached to the side wall part 37 can be shaken off.

Further, in the above embodiment, the configuration is described in which the developer container 3 has two cylindrical parts 301, 302. However, the present invention is not limited to such a configuration.

Further, in the above embodiment, the configuration is adopted in which the agitation film 51 of the agitation member 5 slides against the inner peripheral surface of the substantially cylindrical shutter 34. However, it is also possible to adopt a configuration in which, depending on the shape of the shutter, the agitation film 51 of the agitation member 5 slides against the inner peripheral surface of the developer containing part.

The side edge 51*e* of the agitation film 51 and the inner surface of the side wall 35 lies in a perpendicular direction from the rotation axis 5A in a manner in which the side edge 51*e* slides over the inner surface when rotating around the rotation axis 5A. However, the side edge 51*e* of the agitation film 51 and the inner surface of the side wall 35 may incline corresponding to each other. When the inner surface of the side wall 35 has a cone shape protruding inside, of which a top is on the rotation axis 5A, the side edge 51*e* of the agitation film may be tilt so that the edge 51*e* fits in a slope of the cone shape of the side wall 35. In such a construction, the distal edge 51*c* is longer than the proximal edge 51*f*.

In the above embodiment, the printer provided with the developer container is described. However, the present invention can also be applied to image forming apparatuses such as a facsimile machine, a copying machine, and a combined equipment combinedly having those functions, and image forming units therein.

What is claimed is:

1. A developer container comprising:

a developer containing part that has an cylindrical hollow shape inside and contains developer therein; and an agitation member that is elastic and rotatably provided inside the developer containing part, rotating around a rotation axis that is a center of the cylindrical hollow shape, having at least a side edge extending substantially orthogonal to the rotation axis, wherein the developer containing part has a side wall part on one end thereof in a direction of the rotation axis of the agitation member, the side wall part extending to correspond to the side edge of the agitation member and the agitation member scraping a surface of the side wall part while the agitation member rotates, the side wall part has a projection part that projects toward inside of the developer containing part so that the side edge of the agitation member is elastically deformed by the projection part when passing over the projection part.

2. The developer container according to claim 1, wherein the agitation member is composed with an elastically deformable agitation part and a support part, which are combined each other, the agitation part has basically a quadrangle shape, one of longitudinal edges thereof being a proximal end that is attached to the support part, the other of longitudinal edges being a distal edge that is farther to the rotation axis than the proximal edge and extending substantially parallel to the rotation axis, the side edge connecting the distal and proximal edges, the support part is a shaft rotating around the rotation axis.

3. The developer container according to claim 2, wherein a distance from the rotation axis to the distal edge of the agitation part is longer than an inner radius of the developer containing part.

4. The developer container according to claim 3, wherein due to rotation of the agitation member, the distal edge of the agitation part scrapes an inner peripheral surface of the developer container.

5. The developer container according to claim 3, wherein, the developer containing part further has a supply port for supplying the developer contained therein to outside, and a shutter that is in a thin tube shape of which an outer diameter fits to an inner diameter of the cylindrical hollow shape of developer containing part, rotating around the rotation axis, and having an opening that corresponds to the supply port so that the developer inside goes downwardly through the supply port and the opening when the supply port meets the opening, due to rotation of the agitation member, the distal edge of the agitation part scrapes an inner peripheral surface of the shutter.

6. The developer container according to claim 2, wherein the agitation part has a slit that extends from the distal edge in a direction substantially orthogonal to the rotation axis.

7. The developer container according to claim 2, wherein in the direction of the rotation axis, a distance (D1) that is measured from the side edge of the agitation part to the slit, and a distance (D2) that is measured from a wall surface of the side wall part to a distal end of the projection part satisfy a relation below:

$$D1>D2.$$

8. The developer container according to claim 2, wherein in a direction orthogonal to the rotation axis, a distance (L1), which is measured from the rotation axis to a slit end of the slit of the agitation part, and a distance (L2), which is measured from the rotation axis to the projection part of the side wall part, satisfy a relation below:

$$L1<L2.$$

9. The developer container according to claim 8, wherein the distance (L1) of the agitation part and the distance (L2) of the projection part further satisfy a relation below:

$$1.3\times L1\leq L2\leq 1.8\times L1.$$

10. The developer container according to claim 2, wherein the agitation part and the support part are separately formed, and the agitation part is attached to the support part in such a manner that two side ends of the agitation part in the direction of the rotation axis move, in a rotation direction of the agitation member, ahead of a central part of the agitation part in the direction of the rotation axis.

11. The developer container according to claim 2, wherein the agitation part and the support part are separately formed, the agitation part has a constant width in the orthogonal direction, having a plurality of slits arranged with an interval, the slits extending from the distal edge toward the proximal edge, and the support part has side heights (d2) at the both ends in the rotation axis and has a height (d1) at the middle in the rotation axis, the side heights (d2) being greater than the height (d1).

12. The developer container according to claim 2, wherein the agitation part is rectangle, another side edge is arranged, which is on the other end from the side edge in the direction of the rotation axis, the side edge and the another side edge extend perpendicular to the rotation axis, the developer containing part has another side wall part on the other end in the direction of the rotation axis, the another side wall part has a projection part that projects toward the inside of the developer containing part, and the another side edge scraps a surface of the another side wall part while the agitation member rotates.

13. The developer container according to claim 12, wherein the agitation part has a strip-like portion between each of side edges of the agitation part and slits adjacent to the each of the side edges, the strip-like portion having a predetermined length (D1) in the direction of the rotation axis, the side edges respectively opposing the side wall parts of the developer containing part and the slits extending in a direction substantially orthogonal to the rotation axis from the distal edge of the agitation part.

14. An image forming apparatus comprising:

the image forming unit according to claim 12.

15. The developer container according to claim 1, wherein the developer containing part has a supply port for supplying the developer contained therein to outside, and the projection part is arranged at a position that is in the vicinity of and above the supply port in a cross section orthogonal to the rotation axis.

16. The developer container according to claim 1, wherein the projection part is composed with a plurality of the projection parts, and the projection parts are arranged on outer circumference of the side wall part, all of which are facing in the same direction.

17. The developer container according to claim 1, wherein the projection part has a sloped part of which an amount of projection toward the inside of the developer containing part increases as the sloped part separates away from the rotation axis.

18. An image forming unit comprising:

the developer container according to claim 1.

19. An image forming apparatus comprising:

the developer container according to claim 1.

* * * * *